US008958733B2

(12) United States Patent
Nishida et al.

(10) Patent No.: US 8,958,733 B2
(45) Date of Patent: Feb. 17, 2015

(54) FIXING PRESSURE MEMBER AND PRODUCTION METHOD THEREFOR

(71) Applicants: Nok Corporation, Tokyo (JP); Synztec Co., Ltd., Tokyo (JP)

(72) Inventors: Akira Nishida, Kanagawa (JP); Shingo Sugiyama, Kanagawa (JP)

(73) Assignees: Nok Corporation, Tokyo (JP); Synztec Co., Ltd., Tokyo (JP)

( * ) Notice: Subject to any disclaimer, the term of this patent is extended or adjusted under 35 U.S.C. 154(b) by 24 days.

(21) Appl. No.: 13/859,049

(22) Filed: Apr. 9, 2013

(65) Prior Publication Data

US 2013/0266354 A1 Oct. 10, 2013

(30) Foreign Application Priority Data

Apr. 10, 2012 (JP) ..... 2012-089635

(51) Int. Cl.
*G03G 15/20* (2006.01)

(52) U.S. Cl.
CPC ..... *G03G 15/2089* (2013.01); *G03G 15/2053* (2013.01); *G03G 2215/2035* (2013.01)
USPC ..... 399/329; 329/328; 219/216

(58) Field of Classification Search
USPC ..... 399/122, 320, 328, 329; 219/216
See application file for complete search history.

(56) References Cited

U.S. PATENT DOCUMENTS

| | | | | |
|---|---|---|---|---|
| 5,999,788 | A * | 12/1999 | Kanesawa et al. | 399/329 |
| 8,219,015 | B2 * | 7/2012 | Shinshi et al. | 399/329 |
| 2007/0059065 | A1 * | 3/2007 | Takada et al. | 399/329 |
| 2009/0014942 | A1 * | 1/2009 | Okuno | 271/4.06 |
| 2009/0074485 | A1 * | 3/2009 | Takada | 399/329 |
| 2009/0208263 | A1 * | 8/2009 | Hanyu et al. | 399/329 |
| 2011/0206426 | A1 * | 8/2011 | Komuro | 399/329 |
| 2011/0274473 | A1 * | 11/2011 | Shinshi et al. | 399/329 |
| 2012/0275832 | A1 * | 11/2012 | Suzuki | 399/329 |
| 2013/0034374 | A1 * | 2/2013 | Ohtsu et al. | 399/329 |

FOREIGN PATENT DOCUMENTS

JP 2006-119263 5/2006

* cited by examiner

*Primary Examiner* — Francis Gray
(74) *Attorney, Agent, or Firm* — Young & Thompson

(57) ABSTRACT

The disclosed fixing pressure member has a simple structure, is produced through simplified production processes, causes no problem due to continued use thereof, and exhibits excellent durability. Also disclosed is a method for producing such. The fixing pressure member employed in a fixing unit of a fixing device includes a sliding sheet having a sliding surface which slides with respect to the inner peripheral surface of a belt of the fixing unit, and an elastic member provided inside the sliding sheet. The sliding sheet is formed of a resin fiber woven fabric, a resin fiber knitted fabric, a resin nonwoven fabric, or a resin film. The elastic member and sliding sheet are formed through integral molding such that the elastic member is bonded to at least the inner surface of the sliding sheet opposite the sliding surface. The sliding surface has thereon an embossment formed through an embossing process.

3 Claims, 3 Drawing Sheets

FIXING PRESSURE MEMBER AND PRODUCTION METHOD THEREFOR

The entire disclosure of Japanese Patent Application No. 2012-089635 filed on Apr. 10, 2012 is expressly incorporated by reference herein.

BACKGROUND OF THE INVENTION

1. Field of the Invention

The present invention relates to a pressure-applying fixing member (herein after referred to as a "fixing pressure member") employed in a fixing device, and to a method for producing the member. More particularly, the present invention relates to a fixing pressure member suitable for use in a fixing unit of an image-forming apparatus such as a copying machine, a facsimile machine, or a laser beam printer.

2. Background Art

Image-forming apparatuses each include an endless fixing belt (may be referred to as an "endless belt" or "endless film") and a pressure roller which is pressed onto such a fixing member, wherein a recording medium having an unfixed toner image thereon is sandwiched by and heat-pressed between the fixing member and the pressure roller. The fixing belt of such a fixing device includes, inside thereof, a fixing pressure member which is located so as to face the pressure roller and which applies pressure from the inside of the fixing belt to the pressure roller, to thereby form a specific nip portion. Generally, such a fixing pressure member is formed of an elastic material (e.g., silicone rubber) for the purpose of attaining favorable image quality. Since such a pressure member must be slid with respect to the inner peripheral surface of the fixing belt, a lubricant (e.g., silicone oil or fluorine-containing grease) is provided between the pressure member and the inner peripheral surface of the fixing belt. In connection therewith, there has been proposed a pressure member which facilitates retention of such a lubricant between the member and the inner peripheral surface of a fixing belt, the pressure member including a pressure pad formed of only an elastic body or formed of the elastic body and a support, and a sheet-like member which is formed of a plurality of layers and provided so as to cover the pressure pad, and the pressure member optionally having, on a surface layer thereof, an embossment formed through secondary processing (see Patent Document 1).

The aforementioned sheet-like member has a three-layer structure, and must be provided so as to cover the pressure pad; i.e., the sheet-like member must be fixed to the pressure pad so as to cover it after having been formed through molding and an optional embossing process. Therefore, the sheet-like member poses a problem in that its processing and attachment require a large amount of time and cost. In addition, problems arise in that the sheet-like member, which covers the pressure pad and is partially fixed thereto, deforms in a movement direction through repeated sliding, and the friction resistance of the sheet-like member increases through continued use thereof. In the worst case, the sheet-like member may cause stoppage of the rotation of the fixing belt, or may cause shortening of the service life of the fixing device.

Patent Document 1: Japanese Patent Application Laid-Open (kokai) No. 2006-119263

SUMMARY OF THE INVENTION

In view of the foregoing, an object of the present invention is to provide a fixing pressure member which has a simple structure, which is produced through simplified production processes, which causes no problem due to continued use thereof, and which exhibits excellent durability. Another object of the present invention is to provide a method for producing the fixing pressure member.

In a first mode of the present invention attaining the aforementioned objects, there is provided a fixing pressure member employed in a fixing unit of a fixing device, the fixing pressure member comprising a sliding sheet having a sliding surface which slides with respect to the inner peripheral surface of a belt of the fixing unit, and an elastic member provided inside the sliding sheet, wherein the sliding sheet is formed of a resin fiber woven fabric, a resin fiber knitted fabric, a resin nonwoven fabric, or a resin film; the elastic member and the sliding sheet are formed through integral molding such that the elastic member is bonded to at least the inner surface of the sliding sheet opposite the sliding surface; and the sliding surface has thereon an embossment formed through an embossing process.

A second mode of the present invention is drawn to a specific embodiment of the fixing pressure member according to the first mode, wherein the interface between the elastic member and the sliding sheet has an embossment formed through the embossing process.

A third mode of the present invention is drawn to a specific embodiment of the fixing pressure member according to the first or second mode, wherein the elastic member is formed of rubber, an elastomer, foamed rubber, or a foamed elastomer.

In a fourth mode of the present invention, there is provided a method for producing a fixing pressure member employed in a fixing unit of a fixing device, the method comprising providing, on a die, a sliding sheet formed of a resin fiber woven fabric, a resin fiber knitted fabric, a resin nonwoven fabric, or a resin film, the sliding sheet having a sliding surface which slides with respect to the inner peripheral surface of a belt of the fixing unit; forming an elastic member inside the sliding sheet through integral molding so that the elastic member is bonded to at least the inner surface of the sliding sheet opposite the sliding surface; and subjecting the sliding surface of the sliding sheet to an embossing process.

The fixing pressure member of the present invention exhibits excellent durability, since the sliding sheet and the elastic member are integrally bonded together through integral molding, and the sliding surface of the sliding sheet is embossed. The fixing pressure member can be produced at low cost, since the number of processing and assembly steps are considerably reduced. Since the interface between the elastic member and the sliding sheet has an embossment formed through an embossing process, the elastic member and the sliding sheet are highly strongly bonded to each other. Therefore, even when the fixing pressure member is slid under application of high pressure, displacement of the sliding sheet does not occur. In addition, even when the fixing pressure member is slid under application of high pressure for a long period of time, since the elastic member, which is formed through integral molding, is provided on the back surface of the sliding sheet, the embossment on the sliding surface is less likely to be deformed. Thus, advantageously, the fixing pressure member can be reliably employed over a long period of time.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which.

DETAILED DESCRIPTION OF PREFERRED EMBODIMENTS

The present invention will next be described with reference to embodiments.

Figure 1:
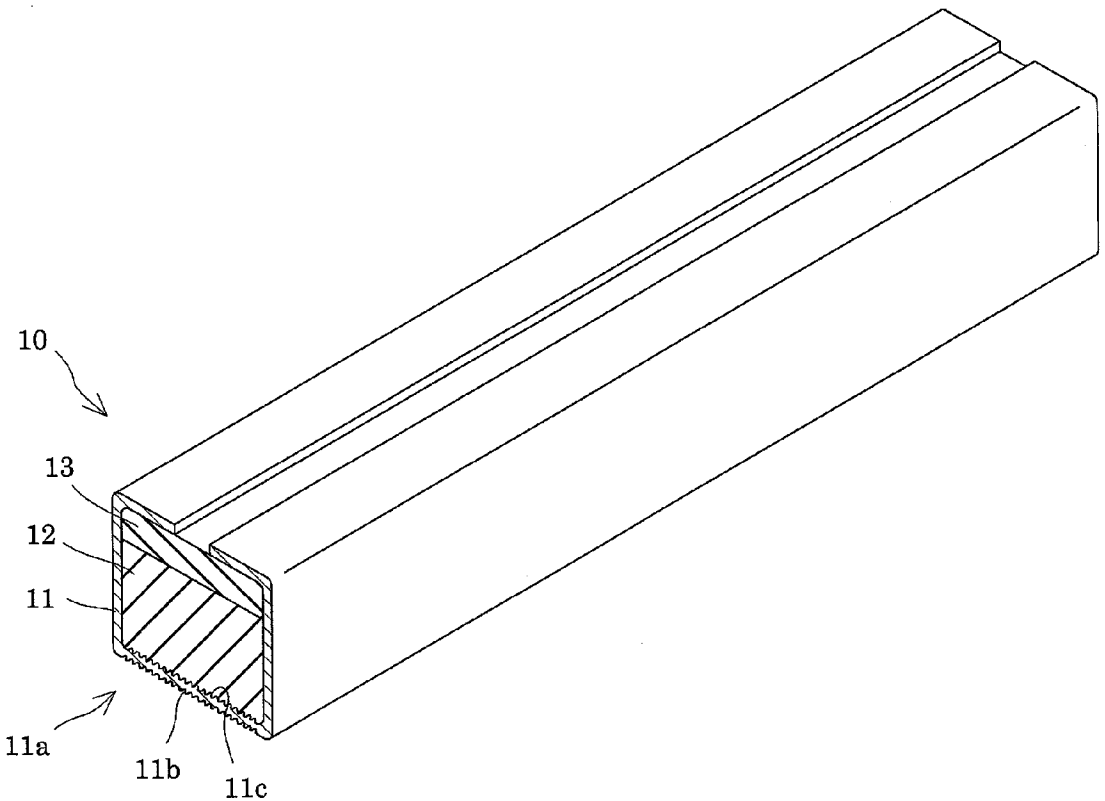
FIG. 1 is a perspective view of a fixing pressure member according to one embodiment of the present invention.

FIG. 1 is a perspective view of a fixing pressure member according to one embodiment of the present invention, the fixing pressure member being provided on the inner peripheral surface of a fixing belt or a pressure belt of a fixing device. As shown in FIG. 1, the fixing pressure member 10 includes a sliding sheet 11; an elastic member 12 formed through integral molding and provided inside the sliding sheet 11; and a support 13 provided on the elastic member 12 on the side opposite the sliding sheet 11. The sliding sheet 11 has a sliding surface 11*a* which slides with respect to the inner peripheral surface of a belt (e.g., a fixing belt), and the sliding surface 11*a* has thereon an embossment 11*b* formed through an embossing process. Since the embossing process is carried out during integral molding of the sliding sheet 11 and the elastic member 12, an embossment is formed at the interface between the sliding sheet 11 and the elastic member 12. Therefore, the bonding strength between the sliding sheet 11 and the elastic member 12 is enhanced, and thus circumferential displacement of the sheet is prevented.

The sliding sheet 11 is formed of a resin having slidability and thermal resistance, such as a fluororesin or a polyimide resin. Specifically, the sliding sheet 11 is formed of a resin fiber woven fabric, a resin fiber knitted fabric, a resin fiber nonwoven fabric, or a resin film. From the viewpoint of retention of a lubricant on the sliding surface, the sliding sheet is preferably formed of a resin fiber woven fabric, a resin fiber knitted fabric, or a resin fiber nonwoven fabric. Meanwhile, from the viewpoint of slidability, the sliding sheet is preferably formed of a resin film; in particular, a film of a fluororesin such as PFA or PTFE.

As described hereinbelow in detail, a raw material of the sliding sheet 11 is placed on a die for molding of the elastic member 12, and the sliding sheet 11 and the elastic member 12 are formed through integral molding so that the elastic member 12 is bonded to at least the surface of the sliding sheet 11 opposite the sliding surface 11*a* (i.e., bonded to the back surface of the sliding sheet 11). During this integral molding, the embossment 11*b* is formed on the sliding surface 11*a*. Also, an embossment 11*c* is formed at the interface between the sliding sheet 11 and the elastic member 12.

Particularly when the sliding sheet 11 is formed of a fluororesin film, preferably, the back surface of the sliding sheet 11 (i.e., the surface opposite the sliding surface) is subjected to a surface treatment before integral molding, for the purpose of further enhancing the bonding strength between the sliding sheet 11 and the elastic member 12. The surface treatment may be, for example, etching treatment, plasma treatment, or excimer laser treatment. When a fluororesin sheet is employed, etching treatment with ammonia is generally carried out. A primer or an adhesive may be applied to the back surface of the sliding sheet 11 before integral molding, and this application may be carried out with or without the surface treatment.

The elastic member 12 is formed of thermally resistant rubber, elastomer, foamed rubber, or foamed elastomer; for example, silicone rubber or elastomer, or fluororubber. Preferably, the heat capacity of the elastic member 12 is reduced for preventing deprivation of heat from a fixing unit. From this viewpoint, the elastic member 12 is preferably formed of foamed rubber or elastomer.

For integral molding of the sliding sheet 11 and the elastic member 12, a raw material of the sliding sheet 11 is placed on a die, and the elastic member 12 is formed through molding with the die. Formation of an embossment on the sliding surface 11*a* of the sliding sheet 11 may be carried out by means of a die having thereon an embossment, or, for example, a metal mesh placed on the die employed.

The support 13 may be a member formed of, for example, a metal or a heat-resistant resin. The support 13 may be bonded to the elastic member 12 through integral molding of the support 13 and the elastic member 12. Alternatively, the support 13 may be bonded to the elastic member 12 by means of an adhesive after molding of the elastic member 12.

The support 13 may be omitted, and the fixing pressure member may be produced by providing the sliding sheet 11 only on the elastic member 12.

Example 1

Figure 2:
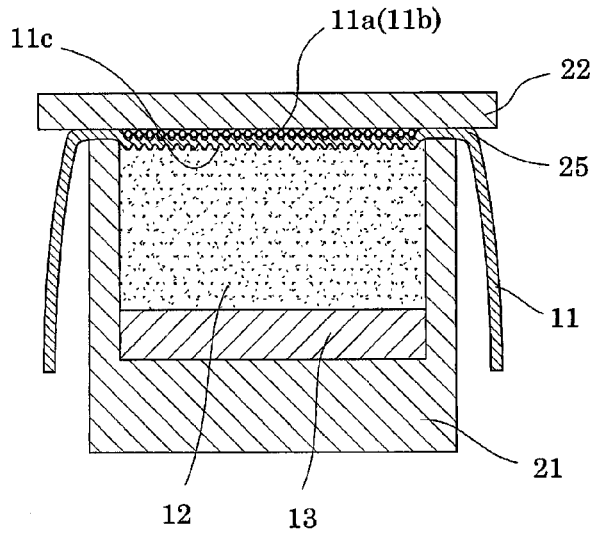
FIG. 2 shows a production method for a fixing pressure member of Example 1 of the present invention.

As shown in FIG. 2, dies having a size corresponding to that of a fixing pressure member were provided. An SUS plate (thickness: 2 mm), serving as a support 13, was provided, and a silicone rubber primer was applied to the SUS plate. The SUS plate was placed in a lower die 21, and liquid silicone rubber (DY35-363, product of Dow Corning Tray, Co., Ltd.) was added to the lower die. Separately, a PFA film (thickness: 70 μm), serving as a sliding sheet 11, was provided. One surface of the PFA film was subjected to etching treatment with liquid ammonia, and a silicone rubber primer was applied to the thus-treated surface. The PFA film was placed on the lower die 21, and a #50 metal mesh 25 for embossing was placed on the PFA film (sliding sheet 11). An upper die 22 was fitted to the lower die, and pressure was applied under heating for seven minutes by means of a press molding machine set at 150° C., to thereby form an elastic member 12. Thus, a fixing pressure member was produced. In the fixing pressure member, the sliding sheet 11, the elastic member 12, and the support 13 were formed through integral molding; the elastic member 12 was bonded to the sliding sheet 11 only at the inner surface opposite a sliding surface 11*a*; an embossment 11*b* was formed on the sliding surface 11*a*; and an embossment 11*c* was formed at the interface between the elastic member 12 and the inner surface of the sliding sheet 11 opposite the sliding surface 11*a*.

Example 2

Figure 3:
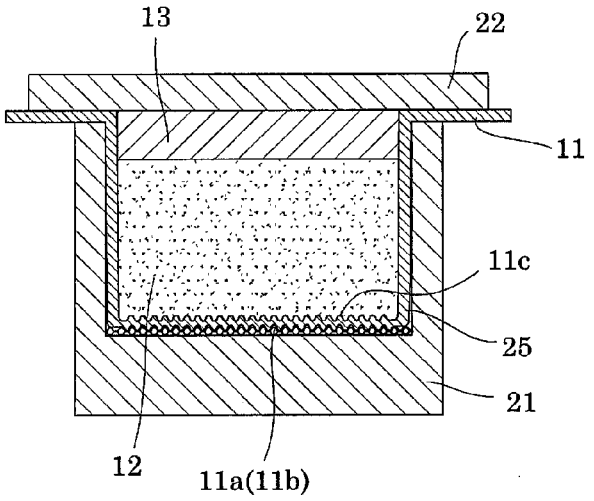
FIG. 3 shows a production method for a fixing pressure member of Example 2 of the present invention.

As shown in FIG. 3, a metal mesh 25 similar to that employed in Example 1 was placed in a lower die 21 similar to that employed in Example 1, and a PFA film (serving as a sliding sheet 11) similar to that employed in Example 1 was placed on the lower die. Subsequently, liquid silicone rubber similar to that employed in Example 1 was added to the lower die, and an SUS plate (serving as a support 13) similar to that employed in Example 1 was placed on the liquid silicone rubber. An upper die 22 was fitted to the lower die, and an elastic member 12 was formed under the same conditions as in Example 1, to thereby produce a fixing pressure member. In the fixing pressure member, the sliding sheet 11, the elastic member 12, and the support 13 were formed through integral molding; the elastic member 12 was bonded to the sliding sheet 11 at the surface opposite a sliding surface 11*a* and at side surfaces of the elastic member 12; an embossment 11*b* was formed on the sliding surface 11*a*; and an embossment 11*c* was formed at the interface between the elastic member 12 and the inner surface of the sliding sheet 11 opposite the sliding surface 11*a*.

Test Example

Figure 4:
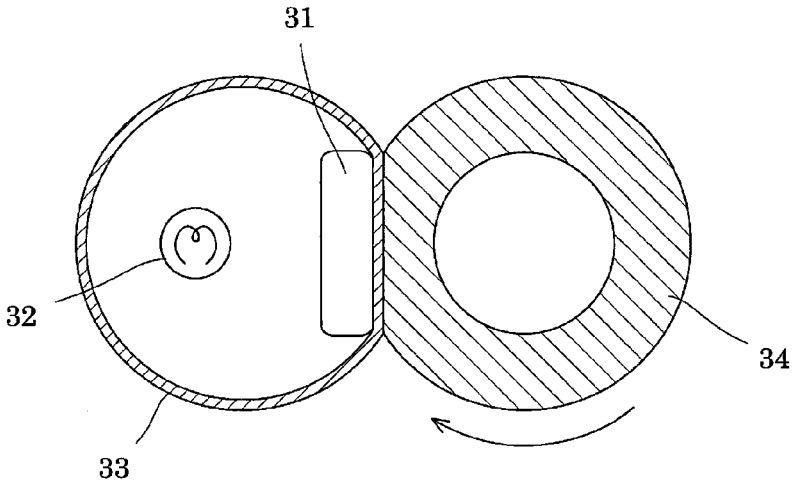
FIG. 4 schematically shows the structure of a test machine employed in the Test Example of the present invention.

A test apparatus as shown in FIG. 4 was employed. In the test apparatus, a fixing pressure member 31 and a heater 32 were placed in a fixing belt 33, and a pressure roller 34 was provided so as to face the fixing belt 33.

There was employed the fixing belt 33 including an electroformed nickel substrate (inner diameter: 30 mm, thickness: 40 μm), a silicone rubber elastic layer (thickness: 100 μm) provided on the substrate, and a PFA tube (thickness: 30 μm) provided on the layer. There was employed the pressure roller 34 including a silicone rubber elastic layer (outer diameter: 30 mm, thickness: 3 mm), and a PFA tube (thickness: 30 μm) provided outside the layer. A halogen heater was employed as the heater 32.

A fixing pressure member produced through the method described in Example 1 (sliding surface width: 10 mm, thickness: 3 mm) was employed as the fixing pressure member 31.

For comparison, a fixing pressure member having the same size as in Example 1 was produced by fixing a fluororesin fabric (product of Gunze Limited) to a pressure member prepared through bonding of silicone rubber to an SUS plate so that the pressure member was bonded to the inner surface of the fabric opposite the sliding surface. The thus-produced fixing pressure member was employed as the fixing pressure member 31, and compared with that of the Example.

The test was carried out as follows. Specifically, fluorine-containing grease was applied to the sliding surface of a fixing pressure member, and the fixing pressure member was placed inside the fixing belt 33. The pressure roller 34 was pressed against the fixing belt 33 (percent compression: about 30%), and the pressure roller 34 was rotated at a linear velocity of 120 mm/sec. While the pressure roller 34 was rotated, temperature was controlled at 150° C. by means of the heater 32.

One hour later, the operation was stopped, and the sliding surface of the sheet was visually observed for determining whether or not deformation occurred. No deformation was observed in the fixing pressure member of the Example. In contrast, in the comparative fixing pressure member, the fluororesin fabric was deformed in a movement direction.

The fixing pressure member of the Example was further subjected to the aforementioned test (operation) for 300 hours. However, no deformation was observed in the sliding surface of the sheet.

What is claimed is:

1. A fixing pressure member employed in a fixing unit of a fixing device, the fixing pressure member comprising:

a sliding sheet having a sliding surface which slides with respect to an inner peripheral surface of a belt of the fixing unit, and an elastic member provided inside the sliding sheet, wherein the sliding sheet is formed of a resin fiber woven fabric, a resin fiber knitted fabric, a resin nonwoven fabric, or a resin film;

the elastic member and the sliding sheet are formed through integral molding such that the elastic member is bonded to at least an inner surface of the sliding sheet opposite the sliding surface;

the sliding surface has thereon an embossment formed through an embossing process; and an interface between the elastic member and the sliding sheet has an embossment formed through the embossing process.

2. A fixing pressure member according to claim 1, wherein the elastic member is formed of rubber, an elastomer, foamed rubber, or a foamed elastomer.

3. A method for producing a fixing pressure member employed in a fixing unit of a fixing device, the method comprising:

providing, on a die, a sliding sheet formed of a resin fiber woven fabric, a resin fiber knitted fabric, a resin nonwoven fabric, or a resin film, the sliding sheet having a sliding surface which slides with respect to an inner peripheral surface of a belt of the fixing unit;

forming an elastic member inside the sliding sheet through integral molding so that the elastic member is bonded to at least an inner surface of the sliding sheet opposite the sliding surface; and subjecting the sliding surface of the sliding sheet to an embossing process, thereby forming an embossment on the sliding surface and forming an embossment at an interface between the sliding sheet and the elastic member.

* * * * *